United States Patent [19]

Oshida

[11] 4,016,012

[45] Apr. 5, 1977

[54] METHOD FOR SURFACE TREATMENT OF METALLIC MATERIALS

[75] Inventor: Yoshiki Oshida, Yokohama, Japan

[73] Assignee: Mitsubishi Jukogyo Kabushiki Kaisha, Tokyo, Japan

[22] Filed: May 8, 1975

[21] Appl. No.: 575,694

[30] Foreign Application Priority Data

June 17, 1974 Japan ..... 49-68112

[52] U.S. Cl. ..... 148/16.5; 148/16.6; 148/131

[51] Int. Cl.[2] ..... C21D 1/48

[58] Field of Search ..... 148/16.5, 20.3, 131, 148/155, 156, 16.6, 110, 12.9

[56] References Cited

UNITED STATES PATENTS

| | | | |
|---|---|---|---|
| 1,939,712 | 12/1933 | Mahoux | 148/12.9 |
| 2,351,922 | 6/1944 | Burgwin | 148/110 |
| 3,201,287 | 8/1965 | Flowers | 148/131 |
| 3,469,829 | 9/1969 | Fujita et al. | 148/131 |
| 3,510,367 | 5/1970 | Berger | 148/15 |
| 3,537,913 | 11/1970 | Klisowski | 148/131 |
| 3,870,572 | 3/1975 | Brugger et al. | 148/16.5 |
| 3,891,474 | 6/1975 | Grange | 148/16.5 |

*Primary Examiner*—Walter R. Satterfield
*Attorney, Agent, or Firm*—Cushman, Darby & Cushman

[57] ABSTRACT

An improved method for surface treatment of metallic materials is described herein. The improvement exists in that a surface treatment agent and a metallic material to be treated are placed in a treating device, heating of the metallic material to be treated up to a specific upper limit temperature higher than a transformation point of the metallic material and cooling of the metallic material down to a specific lower limit temperature lower than the transformation point are alternately and repeatedly carried out, an appropriate stress is applied to the material when it takes the lower limit temperature, and after an appropriate number of temperature cycles the applied stress is released when the material takes the lower limit temperature.

1 Claim, 3 Drawing Figures

Figure 3:
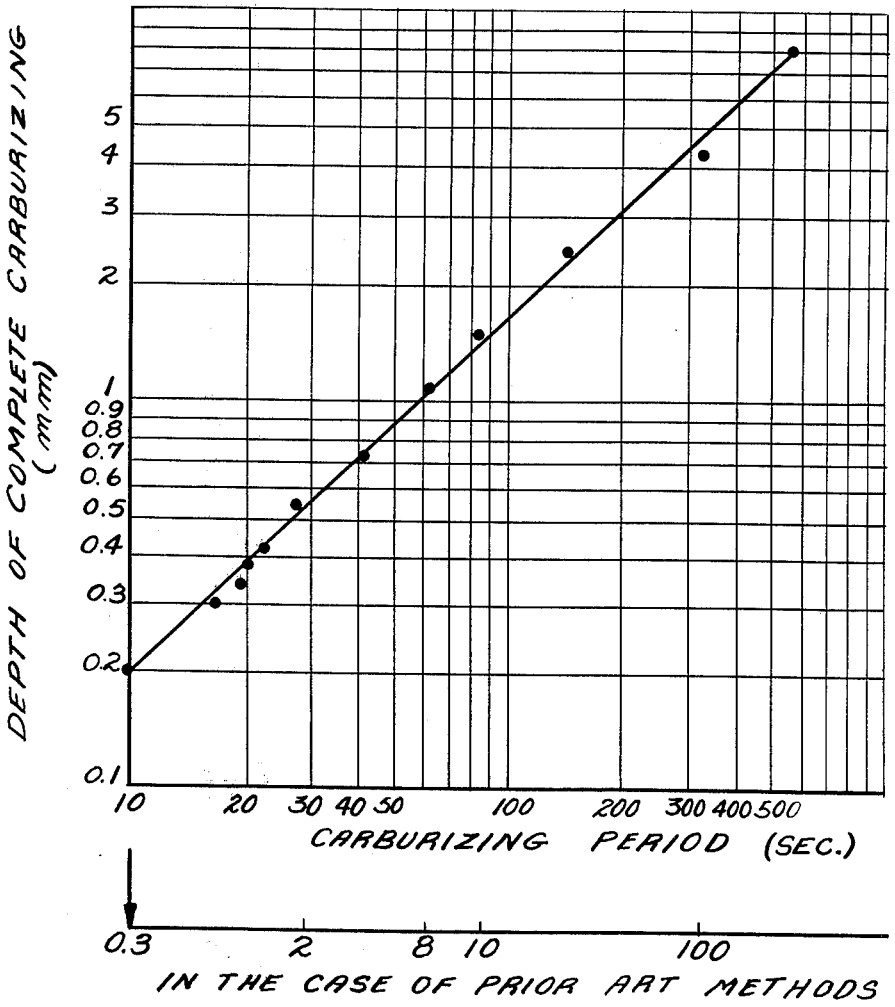

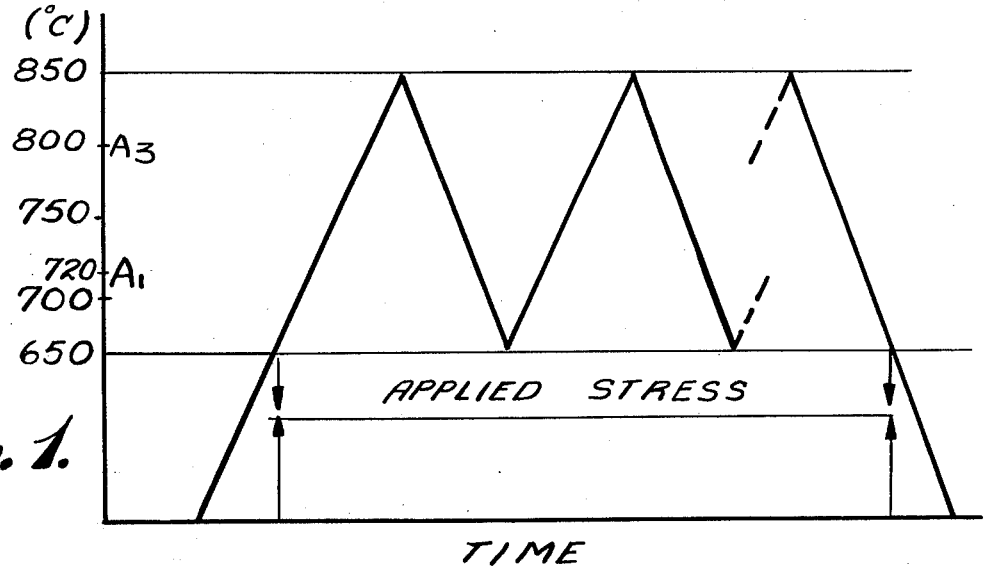
Fig. 1.
Fig. 2.
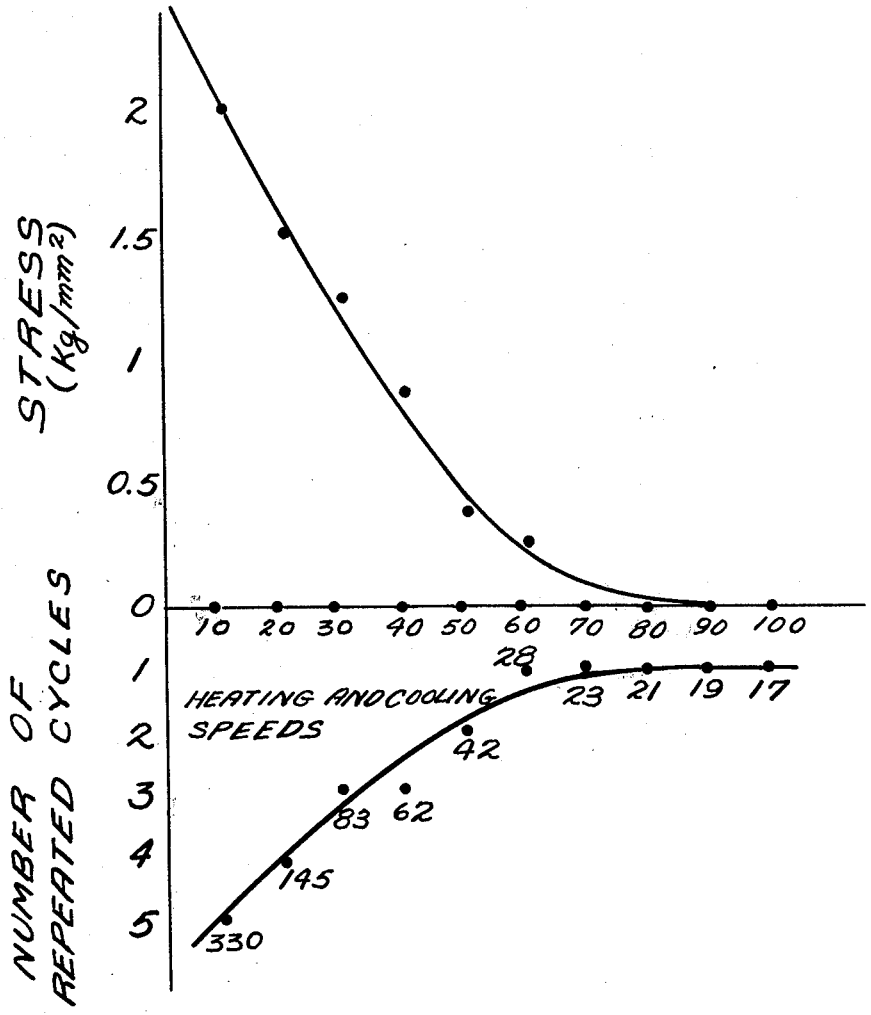

METHOD FOR SURFACE TREATMENT OF METALLIC MATERIALS

The present invention relates to a method for surface treatment of metallic materials, and more particularly, to a method for surface treatment by making use of super-plastic phenomena at a transformation point of a metallic material.

The conventional methods for surface treatment that have been heretofore practiced, necessitated a considerable period of time to provide a desired depth of surface treatment, regardless of whether the surface treatment agent is solid, liquid or gas. In addition, in view of economy for process control and future prospect of the methods for surface treatment, the method employing a solid treatment agent is reduced in use, the method employing a liquid treatment agent is steady in use, the method employing a gas treatment agent is marked as hopeful over the world. This is because the impregnation of the treatment agent into the metallic material to be treated is, whether the treatment is carburizing or nitriding, considered to be a diffusion-governed process. However, according to these prior art methods, it was necessary to control the activated carbon or nitrogen always at a constant state during the entire process of surface treatment, such control operation required a high degree of technique, and thus it was impossible to carry out the surface treatment in a simple manner.

Therefore, it is a principal object of the present invention to provide an improved method for surface treatment of metallic materials in which a desired depth of surface treatment can be achieved within a very short period of time in a simple manner in constrast to the prior art methods.

During an experimental research on super-plastic solid-phase bonding, the inventor of the present invention discovered the fact that at a boundary surface for press bonding between soft steel and cast iron which have different carbon contents, carbon was impregnated by diffusion from the cast iron into the soft steel, and thereby the soft steel was carburized. On the basis of this discovery, the inventor has investigated the possibility of surface treatment of metallic materials by making use of super-plastic phenomena of the metallic materials, and as a result the present invention has been worked out.

According to one feature of the present invention, there is provided a method for surface treatment of metallic materials, characterized in that a surface treatment agent and a metallic material to be treated are placed in a treating device, heating of the metallic material to be treated up to a specific upper limit temperature higher than a transformation point of the metallic material and cooling of the metallic material down to a specific lower limit temperature lower than the transformation point are alternately and repeatedly carried out, an appropriate stress is applied to the material when it takes the lower limit temperature, and after an appropriate number of temperature cycles the applied stress is released when the material takes the lower limit temperature.

Above-mentioned and other features and objects of this invention will become more apparent by reference to the following description taken in conjunction with the accompanying drawings, in which:

FIG. 1 is a diagram showing temperature cycles and a relation of applied stress vs. time which are employed upon carburizing soft steel according to one preferred embodiment of the present invention, FIG. 2 is a diagram showing relations of an applied stress and a repeated number of cycles vs. heating and cooling speeds in a temperature cycle in case that a given fixed depth of carburizing is provided under the temperature cycles shown in FIG. 1, and FIG. 3 is a diagram showing a relation of a treatment period vs. a depth of complete carburizing with respect to the method according to the present invention and the prior art method, respectively.

Now the present invention will be described in more detail with reference to the accompanying drawings. Temperature cycles and a relation of an applied stress vs. time which are employed upon carburizing soft steel according to one preferred embodiment of the present invention, are illustrated in FIG. 1, and relations of an applied stress and a repeated number of cycles vs. heating and cooling speeds in a temperature cycle in case that a given fixed depth of carburizing is provided under the temperature cycles shown in FIG. 1 are illustrated in FIG. 2, in which numerals inscribed in the vicinity of dot marks (.) represent treatment periods in seconds. Also, a relation of a treatment period vs. a depth of complete carburizing is shown in FIG. 3 with respect to the method according to the present invention and the prior art method (a gas carburizing method: carburizing temperature of 900° C), respectively.

Referring now to FIG. 1, in the illustrated example, SS41 soft steel) was employed as a metallic material to be treated. This soft steel has an $A_1$-transformation ($\alpha + Fe_3C \rightleftharpoons \alpha + \gamma$) point at about 720° C and an $A_3$-transformation ($\alpha + \gamma \rightleftharpoons \gamma$) point at about 800° C. Accordingly, the upper limit temperature is set at 850° C, while the lower limit temperature is set at 450° C, so that the temperature cycle may pass over these both transformation points, and thereby temperature cycles may be established so as to heat and cool the material between these upper and lower limit temperature. While the upper and lower limit temperatures have been set at the above-referred values in the illustrated example, as the heating and cooling speeds are increased, the upper limit temperature must be set at a higher value and the lower limit temperature must be set at a lower value. In this case, the range of variation of temperature is admitted to deviate from the above-referred upper and lower limit temperature values by about ±20° C.

As heating means for applying temperature cycles in a saw tooth shape of triangular waveform as shown in FIG. 1, any heating system such as a direct electric heating system in which an electric current is directly passed through the metallic material to be treated to utilize a Joule's heat or an indirect heating system within the treating device could be employed. Also as cooling means, any cooling system such as a forced cooling system making use of an inert gas or a natural cooling system could be employed.

With regard to the applied stress as marked in FIG. 1, the magnitude of the stress should be appropriately selected in accordance with the kinds of the metallic materials to be treated and the employed temperature cycles. It is to be noted that the moment when the stress is applied to the material is the time point when the temperature of the metallic materials to be treated has reached the lower limit temperature of the temperature cycles, and that the moment when the applied stress is removed is also the time point when the temperature of the metallic material to be treated has reached the lower limit temperature in the final temperature cycle after a number of temperature cycles were repeated. As described, the magnitude of the applied stress would vary depending upon the treatment condition, and by way of example, in the case of carburizing generally it falls within the range of 0–2 kg/mm². This magnitude of the applied stress can be determined by reference to the data shown in FIG. 2 which gives the relation of the applied stress vs. the heating and cooling speeds in a temperature cycle in case that a given fixed depth of carburizing is provided under the temperature cycles shown in FIG. 1. In more particular, in case that the heating and cooling speeds are sufficiently fast, in the phase transformation process the diffusion-governed transformation speed cannot follow the heating and cooling speeds in the temperature cycle, so that an unequilibrium state would arise and thereby the surface diffusion velocity of the surface treatment agent would be increased abruptly. Accordingly, the applied stress at that time could be made very small, and sometimes it would be even unnecessary at all. Also even in case that the heating and cooling speeds in a temperature cycle are slow, a sufficient effect can be obtained with an applied stress about 1/10 times as small as the yielding point stress (about 25 kg/mm² in the case of SS41 soft steel) of the metallic material to be treated.

If the surface treatment agent is gas such as, for example, CO gas supplied from a CO gas bomb or CO gas generated upon thermal cracking of methyl acetate, isopropyl alcohol and the like, then the application of the stress could be achieved by injecting the surface treatment agent gas as pressurized into an air-tightly sealed treating device containing the metallic material to be treated, Or, if the surface treatment agent is solid such as, for example, a solid carburizing agent consisting of fine carbon powder added with 10–30% of $BaCO_3$ serving as a carburizing accelerator, then the application of the stress could be achieved by pressurizing a treating device to be treated with an external pressurizing system employing a hydraulic pressure. As described, the means for applying the stress can be arbitrarily selected in accordance with the type of the surface treatment agent.

In the following, one example of practical embodiments of the present invention will be described:

EXAMPLE

In an SS41 soft steel cylindrical rod having a similar shape to a tensile test piece, was bored a cavity extending in the lengthwise direction, a solid carbuzing agent consisting of a charcoal fine powder (320 mesh) mixed with 20% $BaCO_3$ was packed into the cavity, an end portion of the cavity was closed, and after the upper and lower limit temperatures as described with reference to FIG. 1 have been preset, various temperature cycles were applied to the soft steel rod with direct electric heating and forced cooling by an inert gas. Thus the results shown in FIG. 2 were obtained.

The relation of the depth of complete carburizing vs. the carburizing period according to the above-described process is shown in FIG. 3 in contrast to the results obtained according to the prior art process (a gas carburizing process: carburizing temperature of 900° C). As will be seen from FIG. 3, it is obvious that according to the method of the present invention the desired treatment can be accomplished within a very short period of time in contrast to the prior art method.

Although the method according to the present invention has been described above, by way of example, in connection to a carburizing process, the invention is essentially directed to a method for surface treatment by making use of transformation super-plastic phenomena of metallic materials, and therefore, it is applicable not only to carburizing, but also to other surface treatment processes such as, for example, nitriding, carburizing-nitriding, sliconizing, boriding, etc.

While I have described above the principle of my invention in connection with a specific preferred embodiment, it is to be clearly understood that this description is made only by way of example and not as a limitation to the scope of my invention as set forth in the accompanying claim.

What is claimed is:

1. A method for carburization of soft steel with a surface treatment agent to diffuse carbon into the soft steel, that is characterized as having at least two phase transformation temperatures, comprising placing the surface treatment agent which is selected from the group consisting of CO, carbon and carbon admixed with $BaCO_3$ and the soft steel in a treating device;

heating said soft steel and surface treatment agent over a temperature cycle, wherein the minimum temperature of said cycle is below the lower of said two phase transformation temperatures and the maximum temperature of said cycle exceeds the higher of said two phase transformation temperatures, wherein said heating over said cycle is undertaken alternately and repeatedly and is continuous between said minimum and maximum temperature as indicated by the broken line in FIG. 1 in the drawing; and applying a stress to said agent and soft steel, said stress ranging from 0 to 2 kg/mm², when the material is heated to the lower limit temperature and releasing said stress at the end of one of said cycles at the minimum temperature, to effect carburization of the soft steel.

* * * * *